United States Patent [19]

Svoboda et al.

[11] 4,336,654

[45] Jun. 29, 1982

[54] ADJUSTING DEVICE FOR SKI BINDINGS

[75] Inventors: Josef Svoboda; Rupert Hofbauer, both of Schwechat, Austria

[73] Assignee: TMC Corporation, Baar, Switzerland

[21] Appl. No.: 74,624

[22] Filed: Sep. 12, 1979

[30] Foreign Application Priority Data

Sep. 29, 1978 [AT] Austria ..... 7068/78

[51] Int. Cl.[3] ..... A43D 1/00; A63C 9/08

[52] U.S. Cl. ..... 33/3 A; 33/174 R; 280/634

[58] Field of Search ..... 33/3 R, 3 A, 3 B, 143 C, 33/174 R, 174 D, 180 R; 280/616, 633, 634

[56] References Cited

U.S. PATENT DOCUMENTS

| | | | |
|---|---|---|---|
| 1,497,739 | 6/1924 | Schelter | 33/3 A |
| 1,555,792 | 9/1925 | Souder | 33/3 A |
| 1,873,663 | 8/1932 | Pietzuch | 33/3 A |
| 3,857,186 | 12/1974 | Salomon | 280/616 |
| 3,921,997 | 11/1975 | Begey et al. | 280/633 |
| 3,987,553 | 10/1976 | Salomon | 280/616 |
| 3,989,274 | 11/1976 | Weigl et al. | 280/634 |

FOREIGN PATENT DOCUMENTS

| | | | |
|---|---|---|---|
| 1810212 | 6/1970 | Fed. Rep. of Germany | 280/633 |
| 2222161 | 7/1973 | Fed. Rep. of Germany | 280/633 |
| 2246669 | 3/1974 | Fed. Rep. of Germany | 280/633 |

*Primary Examiner*—Richard R. Stearns

*Attorney, Agent, or Firm*—Blanchard, Flynn, Thiel, Boutell & Tanis

[57] ABSTRACT

An adjusting device for determining the thrust force of a ski binding capable of movement along the longitudinal axis of a ski, which thrust force is adapted to urge the heel binding into engagement with the heel of the ski boot. The adjusting device includes a rail having a slide slidably mounted thereon. Both the rail and the slide have support surfaces for engaging, respectively, the toe and the heel of a ski boot. A scale having indicia thereon is provided on the rail and the position of the slide relative to the rail is indicated by an indicator juxtaposed the indicia on the scale. The ski binding is then adjusted to a corresponding scale notation on the ski to thereby set the ski binding at the desired position and, consequently, the thrust force at the desired level.

4 Claims, 3 Drawing Figures

ADJUSTING DEVICE FOR SKI BINDINGS

FIELD OF THE INVENTION

The invention relates to an adjusting device for ski bindings for determining the thrust force which must be applied by the heel holder onto the ski boot which is to be clamped between a toe binding and the heel binding, in particular for so-called rental ski bindings.

BACKGROUND OF THE INVENTION

The correct adjustment of thrust forces which act onto the ski boot which is to be clamped in the binding is generally associated with repeated efforts. This is particularly complicated in the case of so-called rental ski bindings, because here adjustments to different ski boot sizes are necessarily frequent, in individual cases are even daily repeated.

Adjusting devices have not presently become known. Only so-called installation teachings for determining the arrangement of ski bindings on the upper surface of skis have become known. These known devices have support surfaces for receiving a ski boot, at the length of which the arrangement of the ski bindings is to take place, wherein said support surfaces are movable relative to one another and wherein an indicating device is also provided, by means of which the relative position of the installation teaching with respect to the ski can be determined. Such devices are described for example in Canadian Pat. No. 733 258 and in French OS No. 2 240 751. Devices for so-called thrust teachings are described for example in U.S. Pat. Nos. 3,857,186 and 3,987,553.

The invention has now the purpose of providing an adjusting device of the above-mentioned type, which does away with both a repeated effort to achieve the correct adjustment and also determines in every case a correct thrust force which corresponds with the ski boot to be adjusted.

The set purpose is inventively attained by providing a rail with a slide, wherein for receiving the ski boot both the rail and also the slide each have a support surface thereon, and by providing on the rail at least a first row of markings, and an indicator on the slide, the slide being movable selectively into a first indicating position, and by providing parallel with respect to the longitudinal extent of the heel holder, preferably on the upper surface of the ski a second row of markings and a mark on a carriage of the heel holder, through which the latter can be adjusted in longitudinal direction of the ski and can be moved into a second indicating position, wherein for a correctly adjusted thrust force, the values of the first and second indicating positions (in the two rows of markings) correspond.

The inventive construction assures a simple, time and work saving adjustment to different length ski boots, wherein at the same time the necessary thrust force, with which the ski boot is to be held between the two ski binding parts, is also determined. For this, only the values of the two indicating positions (in the two rows of markings) must correspond with one another.

BRIEF DESCRIPTION OF THE DRAWINGS

Further characteristics, advantages and details of the inventive adjusting device are described in more detail with reference to the drawings, which illustrate one exemplary embodiment.

FIGS. 1 and 2 illustrate associated views of a first part of the inventive adjusting device, wherein FIG. 1 is a side view and FIG. 2 is a top view.

DETAILED DESCRIPTION

Figure 1:
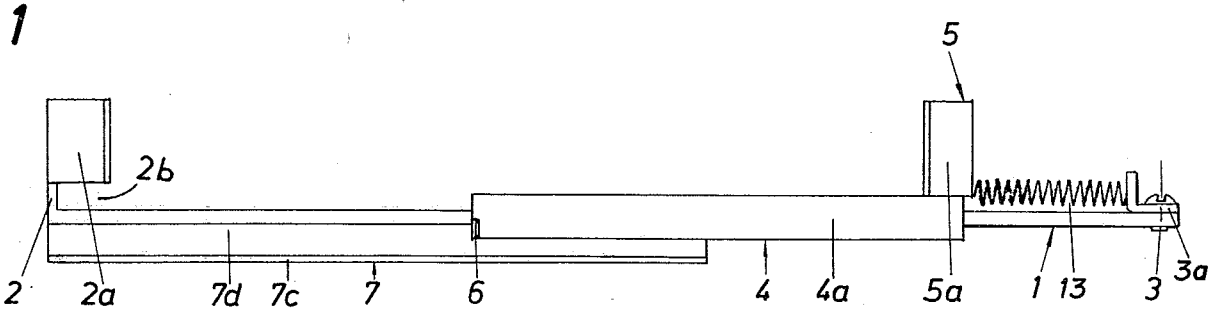
Figure 2:
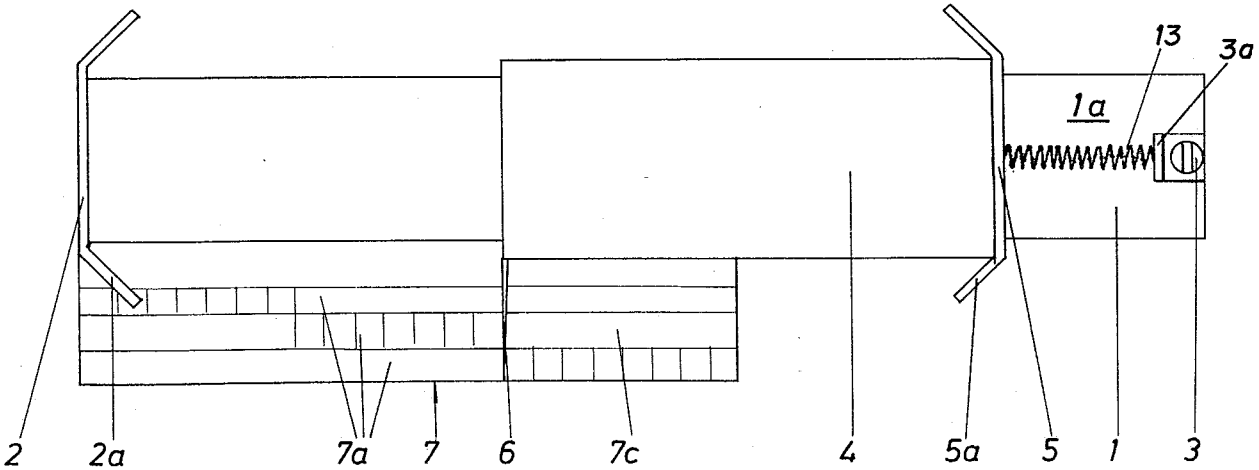

A rail 1 of uniform thickness and having a rectangular shape has at one end an upright support surface 2. The support surface 2 also has a uniform thickness and approximately the same width as the rail 1 and is bent upwardly to form a right angle to the plane of the rail 1. As can be seen from FIGS. 1 and 2, the support surface has a guide plate **2*a* on each side which is bent at an approximately 45° angle from the support surface 2 in direction toward the other end of the rail 1. The upper edge of the support surface 2 is located at an approximate height equal to the upper surface of a common ski boot sole. The upper edges of the two guide plates 2*a* terminate flush with the upper edge of the support surface 2 and the surfaces thereon extend in a direction perpendicular to the plane of the rail 1. The overall height of the two guide plates 2*a* corresponds approximately to three-fourths of the overall height of the support surface 2, so that between the upper surface of the rail 1 and the underside edge of the two guide plates 2*a* there remains a free space 2*b*** which will be discussed further below.

A slide 4 is supported for longitudinal movement on the rail 1. The end of the rail 1 which is remote from the support surface 2 is squared off and has a fillister-head screw 3 thereat. The fillister-head screw 3 is arranged in such a manner on the central longitudinal axis of the rail 1 that its head is provided on the upper surface **1*a* of the rail 1 and located close to the end of the rail 1 with which it is associated. The fillister-head screw 3 extends through the rail 1 and is deformed at its end remote from the head and on the underside of the rail 1 to prevent removal thereof from the rail. As a result, the fillister-head screw 3 forms at the same time a stop for the slide 4, so that the slide 4 which is movable along the rail 1** is also secured against removal from the rail.

The slide 4 has a rectangular base of uniform thickness, wherein the two elongated sides of the slide 4 are constructed as U-shaped bent sections **4*a* which grip around the side edges of the rail 1 and thus secure same against a lifting off from the rail 1. The U-shaped bent sections 4*a* are furthermore designed so that they only loosely enclose the rail 1** for facilitating a satisfactory longitudinal movement along the rail.

The slide 4 has at its end which faces the fillister-head screw 3 a support surface 5, which forms approximately a right angle with the plane of the rectangular base of the slide 4. The support surface 5 has, similar to the support surface 2 of the rail 1, a guide plate **5*a* on each side thereof, which guide plate is bent also at an approximate 45° angle in a direction toward the support surface 2. The guide plates 5*a* and the support surface 5 are designed correspondingly high that their upper edges are in horizontal alignment with the upper edges of the support surface 2 and the two guide plates 2*a***.

The largest inside dimension of the adjusting device between the support surfaces 2 and 5 is determined when the slide 4 engages the fillister-head screw 3. The smallest inside dimension is determined when the left edge of the slide 4 engages the support surface 2. The space **2*b* provided below the two guide plates 2*a* assures a full utilization of the entire available adjusting range by permitting the left edge of the slide 4 to engage the support surface 2**.

The slide 4 has an indicator 6 at its left end which faces the support surface 2 and is arranged substantially parallel with respect to the upper surface 1*a* of the rail 1 and extending laterally outwardly perpendicularly with respect to the longitudinal axis of the rail. Furthermore the rail 1 has on its underside an indicating bar 7. The indicating bar 7 is an L-shaped flange having arms 7*c* and 7*d* thereon. The arm 7*c* is sufficiently wide along the length thereof that three rows of side-by-side markings 7*a* can be and are provided thereon along the length thereof in a direction parallel with respect to the longitudinal axis of the rail 1. The other arm 7*d* is connected to the underside of the rail 1 inside of the adjacent lateral edge of the rail and is short in relationship to the arm 7*c*. The length of the shorter arm 7*d* is just long enough that the slide 4 and its U-shaped bent sections 4*a* slide along the rail without hindrance in the region of the indicating bar 7. The short arm 7*d* of the indicating bar 7 is thereby connected to the rail 1 such that the upper side of the arm 7*c* of the indicating bar 7 with the rows of markings 7*a* thereon is positioned substantially parallel with the upper surface 1*a* of the rail. One end of the indicia or markings on the arm 7*c* of the indicating bar 7 is in alignment with the inside of the support surface 2*a*, the other end is determined by the indicator 6, when the slide 4 engages the fillister-head screw 3. The individual rows of markings 7*a* on the indicating bar 7 are arranged such that the row of markings which is the closest to the rail is intended for use with children's rental ski bindings and the two other rows of markings are intended for use with adult rental ski bindings.

Figure 3:
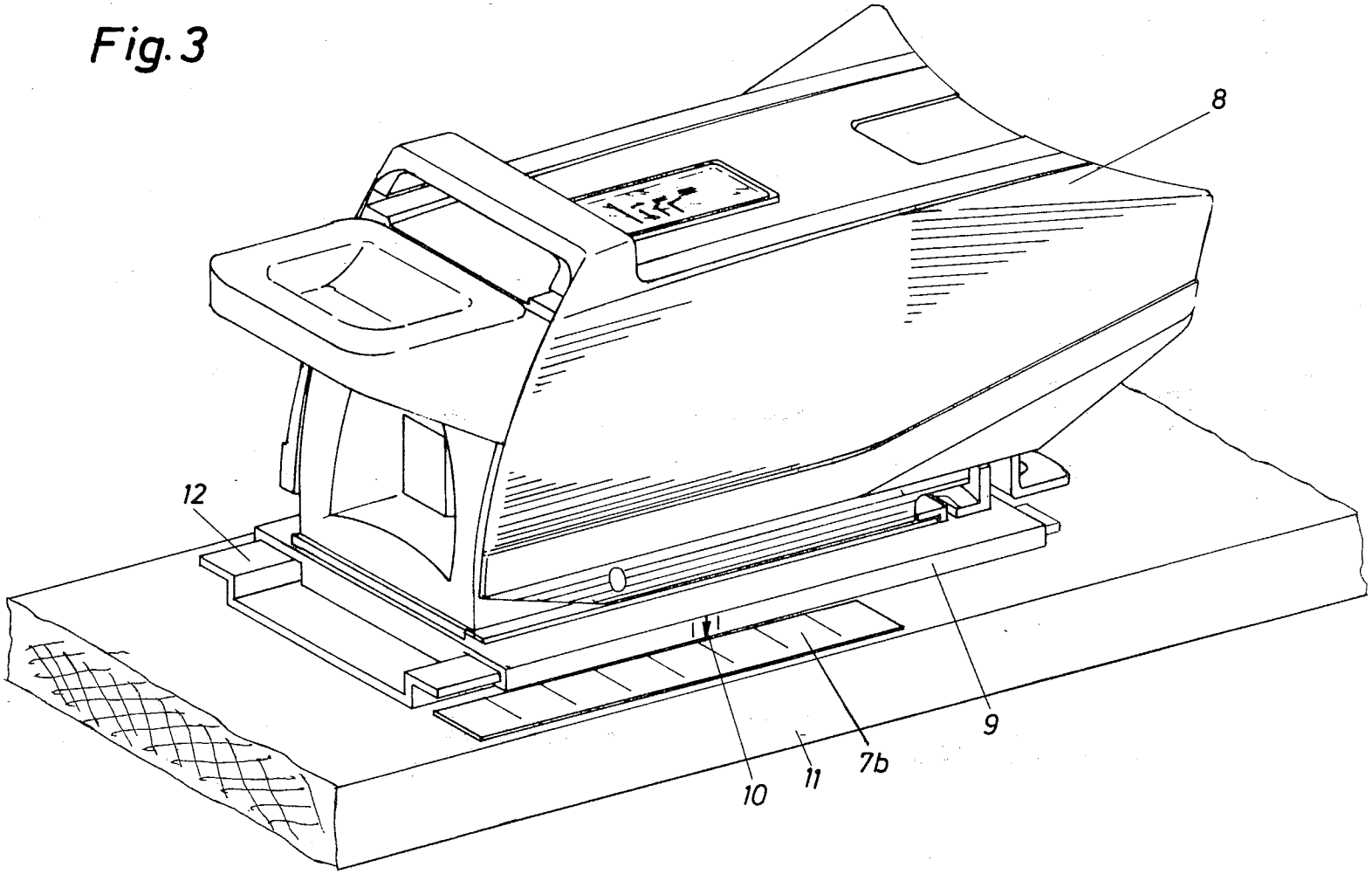
FIG. 3 is a perspective view of a heel holder with a second part of the inventive adjusting device.

The counterpart for the rows 7*a* of markings is, as shown in FIG. 3, a row 7*b* of markings secured to a ski 11 in the region of a conventional heel holder 8. The heel holder 8 is adjustably movable in longitudinal direction of the ski 11 by means of a carriage 9 along a guide rail 12 secured to the ski, through which the entire heel holder 8 is secured on the upper surface of the ski 11. A sample heel binding adjustment arrangement is shown and described in U.S. Pat. Nos. 3,989,274 and 4,022,493 and reference thereto is to be incorporated herein. The carriage 9 of the heel holder 8 has a mark 10 thereon. Consequently, the mark 10 can be selectively adjusted corresponding to the markings in the rows 7*a*.

To adjust the thrust force of a ski binding, in particular of a rental ski binding, one proceeds now in the following manner. The slide 4 is moved to the right away from the support surface 2 until it engages the fillister-head screw 3 to create the largest inside dimension between the two support surfaces 2 and 5. Then the ski boot is positioned on the rail 1 and on the slide 4 so that the toe of the ski boot sole engages the support surface 2. Subsequently the slide 4 is moved to the left in direction of the support surface 2 until the support surface 5 engages the heel of the ski boot sole. The determined value is now read on the indicating bar 7 below the indicator 6 on the corresponding row of markings 7*a*. Then the mark 10 on the carriage 9 of the heel holder 8 is adjusted to the value in the row of markings 7*b* (compare FIG. 3) which corresponds with the read value in the row of markings 7*a*. In other words: For a correctly adjusted thrust force, namely, a spring force which urges the heel binding toward the toe binding and particularly into engagement with the heel of the ski boot, the values of the two indicating positions on the two rows of markings 7*a*, 7*b* correspond. As a result, quick and easy adjustment of a ski binding is achieved, in particular of a rental ski binding. Aside from the savings in time, a correct thrust adjustment for the heel holder and thus in connection with a not-illustrated front jaw, a satisfactory function of the entire safety ski binding is achieved.

The invention is not limited to the illustrated exemplary embodiment. Further modifications can be carried out without departing from the scope of the invention. It would for example be possible to design or arrange the indicating bar 7 differently, or to design the guideway of the slide 4 differently. For example, the slide 4 can be loaded inventively by a compression spring (not illustrated) secured at one of its ends to the fillister-head screw 3 and at its other end to the outside (right side) of the support surface 5 as shown schematically in FIGS. 1 and 2. In this manner, the slide 4 will be urged toward the support surface 2 to automatically set the ski boot to the measured value.

No special requirements are to be made as to the design of the locking and releasing mechanism between the carriage and the guide rail 12 in order to realize the invention. It will be readily understood that if an adjustment with fine graduations is preferred, since in this manner a more exact adjustment of the necessary thrust force is possible, it is inventively preferable for the individual locking positions of the carriage 9 relative to the guide rail 12 to correspond at least with the individual markings.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. An adjusting device for facilitating a correct adjustment of a thrust force applied by a thrust spring onto a heel holder for urging said heel holder toward a toe jaw, said thrust spring yielding in response to the placement of a ski boot between said heel holder and said toe jaw, comprising in combination:

an elongated first rail member;

an elongated slide member movably mounted on said first rail member;

support means mounted on each of said first rail member and said slide member and adjacent ends thereof that are remote from each other for releasably engaging respectively one of a toe portion and a heel portion on said ski boot, said support means including a support surface on said first rail member and on said slide member and at least one guide plate associated with each said support surface, each said guide plate being bent approximately 45° with respect to said associated support surface, the height of each of said support surfaces and of said guide plates corresponding at least with the thickness of a sole of said ski boot which is to be measured, wherein between an upper surface of said first rail member and the underside of said guide plate associated with said support surface on said first rail member there is provided a free space which permits a movement of said slide member to a position abutting said support surface on said first rail member;

first scale means mounted on one of said first rail member and said slide member and having first indicating indicia thereon, first pointer means mounted on the other of said first rail member and said slide member for pointing at an appropriate one of said first indicia in response to a certain length ski boot being present between, and with said toe portion and said heel portion thereof engaging, said support means and;

a heel binding comprising an elongated second rail member which is adapted to be mounted on a ski and a carriage having said heel holder mounted thereon movably mounted on said second rail member, a second scale means mounted on one of said second rail member and said carriage and having second indicating indicia thereon, and a second pointer means mounted on the other of said second rail member and said carriage for pointing at a selected one of said second indicia in response to a relative movement between said second rail member and said carriage and corresponding to the indicia indicated on said first scale means by said first pointer, whereby the position of said carriage and, consequently the position of said heel holder, will be appropriately oriented relative to said toe jaw on said ski.

2. The device according to claim 1, wherein said first rail member has on its end which is remote from its support surface a stop which determines the largest inside dimension between said support surfaces and is arranged on the longitudinal axis of said first rail member, and including securement means for preventing a loss thereof.

3. An adjusting device for facilitating a correct adjustment of a thrust force applied by a thrust spring onto a heel holder for urging said heel holder toward a toe jaw, said thrust spring yielding in response to the placement of a ski boot between said heel holder and said toe jaw, comprising in combination:

an elongated first rail member;

an elongated slide member movably mounted on said first rail member;

support means mounted on each of said first rail member and said slide member and adjacent ends thereof that are remote from each other for releasably engaging respectively one of a toe portion and a heel portion on said ski boot;

stop means for determining the largest inside dimension between said support means on said first rail member and said slide member, said stop means including a stop which is provided on the end of said first rail member remote from said support means thereon and is arranged on the longitudinal axis of said first rail member, and further including securement means for preventing a loss of said stop;

a compression spring for biasing said slide member, one end of said spring being fastened to said stop and the other end of said spring being fastened to said support means on said slide member;

first scale means mounted on one of said first rail member and said slide member and having first indicating indicia thereon, first pointer means mounted on the other of said first rail member and said slide member for pointing at an appropriate one of said first indicia in response to a certain length ski booth being present between, and with said toe portion and said heel portion thereof engaging, said support means; and a heel binding comprising an elongated second rail member which is adapted to be mounted on a ski and a carriage having said heel holder mounted thereon movably mounted on said second rail member, a second scale means mounted on one of said second rail member and said carriage and having second indicating indicia thereon, and a second pointer means mounted on the other of said second rail member and said carriage for pointing at a selected one of said second indicia in response to a relative movement between said second rail member and said carriage and corresponding to the indicia indicated on said first scale means by said first pointer, whereby the position of said carriage and, consequently the position of said heel holder, will be appropriately oriented relative to said toe jaw on said ski.

4. An adjusting device for facilitating a correct adjustment of a thrust force applied by a thrust spring onto a heel holder for urging said heel holder toward a toe jaw, said thrust spring yielding in response to the placement of a ski boot between said heel holder and said toe jaw, comprising in combination:

an elongated first rail member;

an elongated slide member movably mounted on said first rail member;

support means mounted on each of said first rail member and said slide member and adjacent ends thereof that are remote from each other for releasably engaging respectively one of a toe portion and a heel portion on said ski boot;

first scale means mounted on one of said first rail member and said slide member and having first indicating indicia thereon, first pointer means mounted on the other of said first rail member and said slide member for pointing at an appropriate one of said first indicia in response to a certain length ski boot being present between, and with said toe portion and said heel portion thereof engaging, said support means, said first indicia including plural rows of markings, of which one row is designated for a children's ski binding and the other two rows are designated for adult ski bindings; and a heel binding comprising an elongated second rail member which is adapted to be mounted on a ski and a carriage having said heel holder mounted thereon movably mounted on said second rail member, a second scale means mounted on one of said second rail member and said carriage and having second indicating indicia thereon, and a second pointer means mounted on the other of said second rail member and said carriage for pointing at a selected one of said second indicia in response to a relative movement between said second rail member and said carriage and corresponding to the indicia indicated on said first scale means by said first pointer, whereby the position of said carriage and, consequently the position of said heel holder, will be appropriately oriented relative to said toe jaw on said ski.

* * * * *